United States Patent [19]

Fisher, Jr.

[11] 4,362,211

[45] Dec. 7, 1982

[54] LOCKING MANDREL

[75] Inventor: Ernest P. Fisher, Jr., Carrollton, Tex.

[73] Assignee: Otis Engineering Corporation, Dallas, Tex.

[21] Appl. No.: 212,996

[22] Filed: Dec. 4, 1980

[51] Int. Cl.[3] ..... E21B 23/02; E21B 23/08

[52] U.S. Cl. ..... 166/217; 166/383; 166/156

[58] Field of Search ..... 166/138, 140, 153, 156, 166/216, 217, 383

[56] References Cited

U.S. PATENT DOCUMENTS 2,380,612 7/1945 Quintrell ..... 166/140

2,929,453 7/1956 Conrad ..... 166/217

*Primary Examiner*—Stephen J. Novosad

*Assistant Examiner*—Joseph Falk

*Attorney, Agent, or Firm*—Vinson & Elkins

[57] ABSTRACT

A locking mandrel including a pumpdown piston and flow control means in which a dog expander engages a shoulder in a landing nipple and is moved to dog expanded position to lock the locking mandrel in the landing nipple and in which the locking mandrel may be released from the landing nipple by moving the body thereof either upward or downward to shift the expander from under the dogs to permit them to retract and release the landing nipple.

18 Claims, 7 Drawing Figures

32
29c
29
31
29a
19
21b 32
29c
31
19
19c
33
19b
31
21b
29a
19b
34

29c
19c
29
19
29a
19d
21b 34
19
21b
19c
29a

LOCKING MANDREL

This invention relates to locking mandrels and in one form relates to a locking mandrel which may be combined with a flow control device and pumpdown means.

This invention provides a locking mandrel which may be provided as a part of a flow control means which may be utilized in the injection well system disclosed in the prior invention of Arnett and Heard, U.S. patent application Ser. No. 212,994 for WELL SYSTEM AND METHODS, filed on even date herewith.

This invention is an improvement on the valve which is the prior invention of Kilgore, U.S. patent application Ser. No. 212,995, filed on even date herewith. The disclosures of the two above identified applications are incorporated herein in their entirety by reference.

An object of this invention is to provide a locking mandrel which while actuated by engaging a no-go shoulder utilizes lugs which are extended out into a groove in a landing nipple to provide a relative large bearing area between the lugs and the landing nipple.

Another object is to provide a locking mandrel which after it is locked in place in a landing nipple may be released by exerting a force in either an up or down direction on the locking mandrel.

Another object is to provide a locking mandrel which is actuated by engaging a no-go shoulder in a landing nipple and which utilizes lugs extending into a groove in the landing nipple to lock the locking mandrel against movement in either direction and in which the lugs are latched to the body of the mandrel and the locking mandrel is released from the landing nipple by releasing said latch.

Another object is to provide a locking mandrel as in the preceding object in which said latch may be released by force exerted upwardly or downwardly on the locking mandrel and which in the preferred form retains the latching lugs in latching position until the force is substantially removed when a downward force is exerted.

Other objects, features and advantages of the invention will be apparent from the drawings, the specification and the claims.

In the drawings wherein an illustrative embodiment of this invention is shown,

Figure 1:
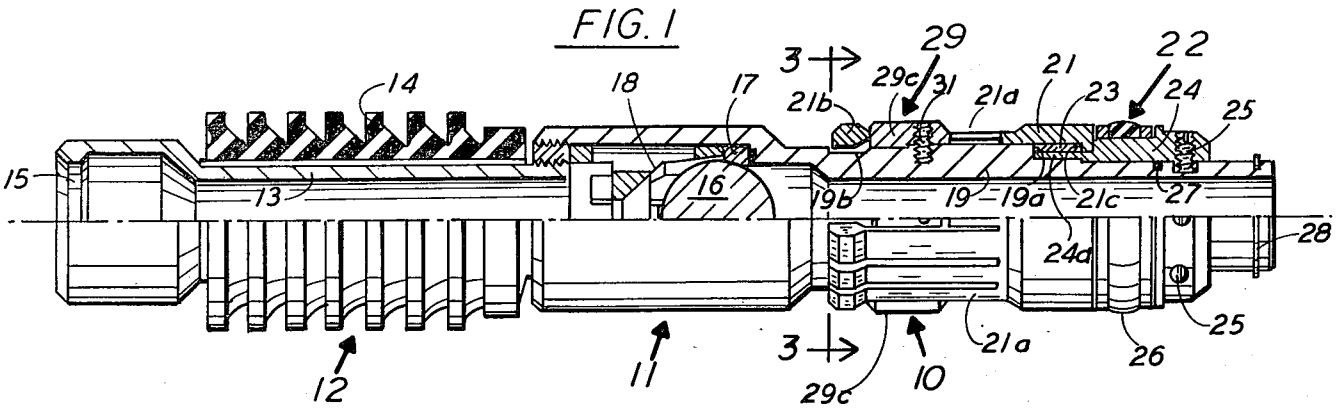
FIG. 1 is a view partly in elevation and partly in quarter section illustrating the locking mandrel of this invention in combination with a back-check valve and pump-in piston so that the entire assembly provides a retrievable or expendable standing valve.

Referring first to FIG. 1, the locking mandrel is indicated generally at 10 and has associated therewith a ball type check valve indicated generally at 11 to permit flow through the assembly in one direction only. As disclosed in the above identified applications filed simultaneously herewith, this type of structure may be used as a standing valve in wells. The structure of FIG. 1 also includes a pumpdown piston assembly 12 for pumping the standing valve into the well as taught in the above identified copending applications. While the pumpdown piston 12 is attached directly to the locking mandrel, it can be separate therefrom as is well known to those skilled in the art. In like manner the back check valve 11 can be separate from the locking mandrel and secured thereto in any desired manner, also as is well understood by those skilled in the art.

The pumpdown piston 12 includes a piston body 13 on which the pumpdown piston rubber 14 is carried. At the upper end of the body 13 an inwardly directed flange 15 is provided to permit the tool to be connected to other structures such as pulling tool.

The back check valve 11 includes the valve member 16 cooperable with seat 17 and maintained in position by the cage 18. The ball check will permit flow upwardly through the standing valve while preventing flow downwardly past the ball 16.

Referring now to the locking mandrel, an elongate body 19 is provided. In the preferred form the valve and seat 16 and 17 are carried by the body and the pump piston body 13 is secured to the locking mandrel body.

A dog carrier provided by a collet 21 is mounted on the body for relative longitudinal movement with the body. The collet 21 has a plurality of collet fingers **21*a* and at the free ends of the collet fingers the dogs or lugs 21*b* are provided. While a collet type of structure is preferred it will be appreciated that the conventional sliding dog holders with radially extensible and retractable dogs such as shown in the Kilgore application, Ser. No. 212,995, identified hereinabove could be employed. In either case, the dogs 21*b* are radially extensible and contractable relative to the dog carrier and the body 19**.

A first releasable latch means secures the dog carrier against longitudinal movement on the body 19. This latch means which is indicated generally at 22 may take any desired form. Preferably it permits the latch means to be prepared for release in response to a selected pressure differential and then to be completely released upon reduction of the differential.

The latch means 22 includes a C-ring 23 held between a downwardly facing shoulder **19*a* on body 19 and an upwardly facing shoulder 21*c* on collet 21. The C-ring 23 is held in expanded condition by a prop-out sleeve 24 having a reduced diameter prop-out section 24*a* between the collet 21 and the body 19**.

The prop-out 24 is releasably secured to the body by a plurality of shear pins 25. These pins may be sheared upon the application of a selected force in the upward direction applied to the locking mandrel while the lugs **21*b* are holding the collet and its prop-out sleeve 24** secured to a conventional landing nipple.

A seal of conventional form is shown at 26 and will normally seal between the locking mandrel and the landing nipple. An O-ring 27 seals between the prop-out sleeve 24 and the mandrel body 19. Thus the application of downward pressure to the seal 26 will result in shearing of the shear pins 25 as soon as the force equals their shear value. If the pumpdown piston rubber 14 is employed and is sealingly engaged with the landing nipple, the ribs of the piston will bend downwardly as well known to those skilled in the art, permitting fluid pressure to bypass the pump piston and be effective on the seal 26. Thus, with the shearing of pins 25 the seal 26 and prop-out sleeve 24 will move downwardly and engage retaining ring 28. In this position the small diameter portion **24*a* of the prop-out ring will move out from under the C-ring 23 and be ineffective. However, due to the pressure differential across the tool and the downward force exerted by the pressure on the body 19, the frictional engagement of the C-ring 23 with its opposing shoulders 19***a* and 21*c* will hold the C-ring expanded. This feature is desirable as in dual installations it permits preparation of more than one standing valve for expulsion at the same time. In other words, with dual strings in communication the desired high pressure will shear standing valve shear pins in two standing valves in dual strings and both standing valves will remain in position to permit the application of this pressure to be exerted until both sets of shear pins have been sheared. Thereafter, when the pressure reduces to a value approaching zero, the frictional engagement of the C-ring with its opposing shoulders will reduce to the point that the ring can contract and release the collet 21 to permit the body to move downwardly relative to the collet dogs 21*b* to expend the standing valve from the bottom of a dual string as will be explained hereinafter.

Figure 2:
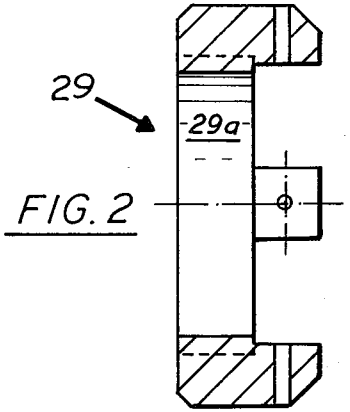
FIG. 2 is a view in cross-section through the expander ring.

To provide for radial outward movement of the collet dogs 21*b* an expander is provided which is slidable on the body and movable into a position to expand said dogs. This expander is indicated generally at 29 and is best shown in FIG. 2. The expander is preferably a C-ring 29*a* which is split at 29*b*.

Preferably, the C-ring carries a plurality of shoulders 29*c* which project radially outwardly from the C-ring and provide a surface for engaging an upwardly facing no-go shoulder in a landing nipple to arrest downward movement of the expander.

Figure 3:
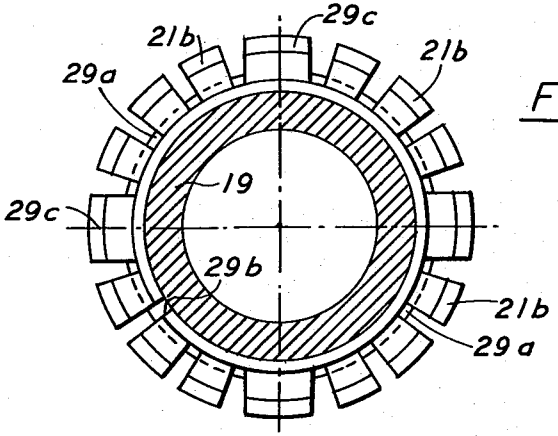
FIG. 3 is a view along the lines 3—3 of FIG. 1.

For purposes which will appear hereinafter it will be noted from FIGS. 2 and 3 that the shoulders 29*c* are spaced radially outward from the inner diameter of the C-ring 29*a*.

A second releasable latch means is provided latching the expander against longitudinal movement of the body 19.

The expander is preferably latched to the body 19 as by a plurality of shear pins 31. Thus, upon arresting movement of the expander by engagement with a no-go shoulder, further downward movement of the body 19 will shear pins 31 and the body 19 will move downwardly relative to the expander and the C-ring 29*a* of the expander 29 will move under the dogs 21 forcing them to move radially outward to latch in an appropriate groove in a landing nipple.

By reference to FIG. 1 it will be noted that the body 19 has an external groove at 19*b*. This groove receives the internal portion of C-ring 29*a*. Thus, when the expander 29 is stopped in a landing nipple and the body moves downwardly, the C-ring snaps into the groove 19*b* at the same time that it expands the lugs 21*b* radially outwardly. This locks the expander in the expanding position and provides a third latch system which when latched will hold the expander in the latched position. This permits the subsequent unlatching of the collet latch to permit moving the body and the expander out from under the collet lugs to release the lugs and permit expulsion or withdrawal of the locking mandrel.

Figures 4, 5, 6, 7:
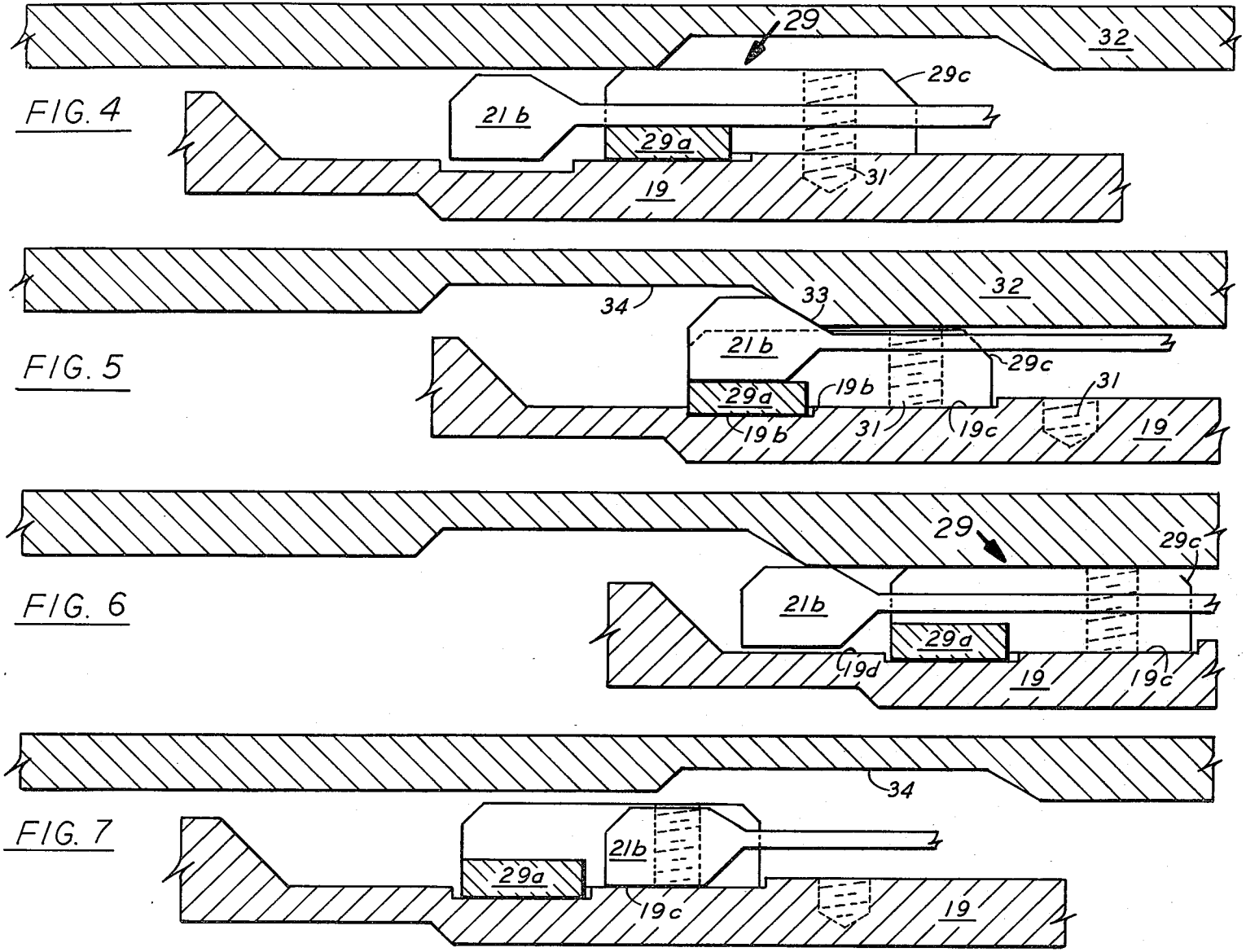
FIGS. 4 through 7 are schematic views of the lug and lug expander illustrating the position of the parts in running, locked, expended and pulled condition, respectively.

Reference is now made of FIGS. 4 through 7, illustrating the relative positioning of the lugs 21*b* and the C-ring 29 in the several positions of the tool. The tool is shown in FIG. 4 to be running into the landing nipple and the C-ring 29 is latched to the body 19 by the shear pins 31. In this condition the lugs 21*b* are retracted and ineffective.

In FIG. 5 the assembly is shown in the locked position. At this time assembly is shown in a landing nipple 32 having an upwardly facing no-go shoulder 33 and a locking groove 34 for receiving the lugs 21*b* and locking the tool in the landing nipple.

As the tool was run into the hole the downwardly facing shoulders 29*c* on the expander ring 29 engaged the upwardly facing landing nipple shoulder 33. This engagement resulted in shearing of the shear pins 31. Further movement of the body 19 downwardly moves the C-ring 29*a* into the groove 19*b* in the mandrel body. It will be noted from this view that in addition to the groove 19*b* the body has a reduced diameter section 19*c* and this reduced diameter section and the groove permit the C-ring and lugs to snap inwardly. The shoulders 29*c* can move inwardly a sufficient distance to completely clear the no-go shoulder 33. It will be understood by those skilled in the art that modern tools generally are limited in the radial dimension of no-go shoulders and only small radial dimensions are normally available for use as no-go shoulders in tools of the nature illustrated. It is therefore preferred to use much larger diameter grooves, such as grooves 34, to cooperate with a number of dogs 21*b* and use the dogs as the primary latching means.

It will be noted from FIG. 5 that with the C-ring contracted to its substantially unstressed position, it lies within the groove 19*b* and will be held against movement relative to the body 19 and the locking mandrel will be locked to the landing nipple.

In FIG. 6 the structure is illustrated in condition in which the tool is to be expended from the body of the landing nipple. In this instance pressure from above will be exerted downwardly on the seals 26 and 27 to shear shear pins 25 and remove the prop-out 24 from under the C-ring 23 permitting the C-ring to contract into the space previously occupied by the upper end 24*a* of the prop-out member. As soon as pressure is reduced across the locking mandrel such that friction no longer holds the C-ring 23 expanded, it will contract to release the expander collet 21. When this occurs downward movement of the body under pressure of force from above will move the body 19 together with the expander 29*a* to a position from under the lugs 21*b*. These lugs may now drop off of the C-ring 29*a* returning to their original retracted position in which the landing nipple is released as shown. For this purpose the body 19 has a surface 19*d* which like surface 19*c* is of a diameter to permit the collet in relaxed condition to position the lugs 21*b* in retracted position out of engagement with landing nipple groove 34. The locking mandrel may now be forced downwardly out of the loading nipple by its own weight or may be pumped out of the nipple.

Reference is now made to FIG. 7 in which the structure is shown in the pulled condition. The tool may have pump locomotives positioned above the conventional H-member in pumpdown completion, or wireline tools may be run in and secured to the shoulder 15 in the upper end of the pump piston body 13. In either event an upward force is exerted which results in shearing of shear pins 25 and after these pins are sheared the entire body is pulled upwardly relative to the collet 21 and its dogs 21*b* to move the body 19 to a position in which the dogs 21*b* reside on the shelf 19*c* of the body. In this position they are again retracted and released from the groove 34 in the landing nipple and the tool may be withdrawn from the well in the conventional manner.

The foregoing disclosure and description of the invention is illustrative and explanatory thereof and various changes in the size, shape and materials, as well as in the details of the illustrated construction, may be made within the scope of the appended claims without departing from the spirit of the invention.

What is claimed is:

1. A locking mandrel comprising, an elongated body, a dog carrier including a collet slidable on the body and including collet fingers having dogs on their free ends, first releasable means securing the collet against longitudinal movement on the body, a C-ring expander slidable on the body for expanding said dogs, said expander including shoulder means for engagement with a landing nipple shoulder and arresting movement of the expander in one direction, second releasable latch means securing said expander against longitudinal movement on the body, and a groove in said body receiving and holding said C-ring expander in dog extended position after said second latch means is released, and said body movable relative to said collet to a position disengaging said expander upon release of said first releasable means.

2. A locking mandrel comprising, an elongated body, a dog carrier mounted on the body for relative longitudinal movement with the body, radially extensible and contractable dog means supported on the dog carrier, first releasable latch means securing the dog carrier against longitudinal movement of the body, an expander slidable on the body for expanding said dog means, and second releasable latch means securing said expander against longitudinal movement on the body, said expander including shoulder means for engagement with a landing nipple shoulder and arresting movement of the expander in one direction, said expander movable to a position locating said expander under said dogs to position them in extended position after said second latch means has been released, said dog carrier and expander relatively movable to a position disengaging said dogs from said expander upon release of said first latch means.

3. The locking mandrel of claim 2 wherein third latch means are provided for latching said expander in dog extending position after said second latch means has been released.

4. The locking mandrel of claims 1, 2 or 3, wherein said first releasable latch means includes a lockout member holding a C-ring expanded, and a shear means releasable to permit the lockout member to release the C-ring, said C-ring held between opposed shoulders on said dog carrier and body and releasable therefrom when the frictional engagement between the ring and shoulder is reduced to a selected value to release said dog carrier after said lockout member releases said C-ring.

5. The locking mandrel of claim 4 wherein said dog carrier and dogs are provided by a collet.

6. The locking mandrel of claim 4 wherein upon release of said first releasable latch means the dogs may move to retracted position upon movement of the body in either longitudinal direction to move the expander means from under the dogs.

7. The locking mandrel of claim 4 wherein flow control means are carried by the body.

8. The locking mandrel of claim 4 wherein flow control means are carried by the body and a pump piston is carried by the body.

9. The locking mandrel of claims 2, or 3, wherein said dog carrier and dogs are provided by a collet.

10. The locking mandrel of claim 9 wherein upon release of said first releasable latch means the dogs may move to retracted position upon movement of the body in either longitudinal direction to move the expander means from under the body.

11. The locking mandrel of claim 9 wherein flow control means are carried by the body.

12. The locking mandrel of claim 9 wherein flow control means are carried by the body and a pump piston is carried by the body.

13. The locking mandrel of claims 1, 2, or 3, wherein upon release of said first releasable latch means the dogs may move to retracted position upon movement of the body in either longitudinal direction to move the expander means from under the dogs.

14. The locking mandrel of claim 13 wherein flow control means are carried by the body.

15. The locking mandrel of claim 13 wherein flow control means are carried by the body and a pump piston is carried by the body.

16. The locking mandrel of claims 1, 2, or 3, wherein flow control means are carried by the body.

17. The locking mandrel of claims 1, 2, or 3, wherein flow control means are carried by the body and a pump piston is carried by the body.

18. The locking mandrel of claims 1 or 2 wherein upon said second releasable latch means being released and said expander moving to a location positioning said dogs in the extended position said expander shoulder means is disengaged from said landing nipple shoulder.

* * * * *